United States Patent [19]

Lord

[11] Patent Number: 4,633,899

[45] Date of Patent: Jan. 6, 1987

[54] DEVICE FOR PROVIDING A TEMPORARY REMEDY FOR CEILING LEAKS

[76] Inventor: Phillip E. Lord, 15 Rose Ave., Venice, Calif. 90291

[21] Appl. No.: 661,168

[22] Filed: Oct. 15, 1984

[51] Int. Cl.[4] ..... F16L 5/00

[52] U.S. Cl. ..... 137/357; 137/312; 52/39; 52/DIG. 12; 141/337

[58] Field of Search ..... 137/312, 313, 357; 141/1, 97, 392, 337, 334, 339; 248/205.3, 317, 323, 328; 135/48; 52/11, 39, DIG. 12; 24/304

[56] References Cited

U.S. PATENT DOCUMENTS

| | | | |
|---|---|---|---|
| 3,003,666 | 10/1961 | Stone | 52/173 |
| 3,561,069 | 2/1971 | Asseo et al. | 24/304 |
| 3,782,388 | 1/1974 | Page | 24/304 |
| 4,180,094 | 12/1979 | Viragh | 137/357 |
| 4,245,666 | 1/1981 | Norris | 137/357 |
| 4,268,000 | 5/1981 | Ulm | 24/304 |
| 4,313,457 | 2/1982 | Cliff | 137/312 |

*Primary Examiner*—Martin P. Schwadron
*Assistant Examiner*—Sheri M. Novack
*Attorney, Agent, or Firm*—Kelly, Bauersfeld & Lowry

[57] ABSTRACT

A rectangular plastic sheet member is provided with adhesive fastenings at its four corners so that it can be secured to a ceiling underlying a leak. A light flexible plastic tube passes from the center of the sheet to an out of the way location for continuously draining collected water from the sheet. The sheet member is light and easily shored. When in use, it will not obstruct the floor. It provides a "poor man's" solution for temporarily stopping leaks from damaging a room area.

2 Claims, 2 Drawing Figures

DEVICE FOR PROVIDING A TEMPORARY REMEDY FOR CEILING LEAKS

FIELD OF THE INVENTION

This invention relates to devices for temporarily providing a remedy for ceiling leaks until such time as the leak can be fixed permanently.

BACKGROUND OF THE INVENTION

In low income areas and particularly in rental units, leaks often develop in the ceiling and the normal remedy is for the tenant to place a pail or bowl under the leak until he can get around to fixing it himself or get the landlord to fix it. As well known by many tenants, it may take days or even weeks to get a landlord to fix anything.

While a pail or bowl works sometimes, if the leak takes the form of a crack, water can drip from spaced points greater than the diameter of the bowl or pail. If the pail is on the floor, accurate alignment is necessary and it presents an obstacle to persons in the room. If it is placed on a ladder, the ladder presents a worst obstacle. In addition, pails and/or bowls require periodic emptying and thus constant vigilance is necessary if water damage is to be avoided.

Prior art devices have been proposed for solving the foregoing problems. The closest prior art of which I am aware is disclosed in U.S. Pat. No. 4,245,666 issued Jan. 20, 1981 to one Norris. In this patent, a funnel shaped sheet is held up at its corners by spokes extending upwardly and outwardly from a stand. This stand is similar to a music stand in that telescoping tubes are provided so that its height may be adjusted. The idea is to position the funnel sheet beneath a leak in the ceiling. A flexible tube passes from the lowest end of the funnel to an out of the way location such as a sink so that water collected in the sheet is continuously drained.

The foregoing arrangement will work to some extent but is relatively bulky and requires assembly of the stand and other components. Further, while the feature of continuous draining is provided, the stand iself presents an obstacle in the room to persons walking about. If the leak is above furniture or a bed, the device with the stand could not in any practical sense be used. In other words, the floor area directly beneath the leak would have to be clear to support the stand.

BRIEF DESCRIPTION OF THE PRESENT INVENTION

With the foregoing in mind, the present invention seeks to overcome the foregoing difficulties and provide a light, compact device that can be easily stored when not in use, is inexpensive and is more effective in remedying leaks than prior devices or which I am aware.

More particularly, in its broadest aspect, my invention includes a flexible water-proof plastic sheet member with at least three, and in the preferred embodiment, four fastening means at spaced locations defining the vertices of a triangle or rectangle as the case may be. These fastening means preferably comprise water resistance adhesive tape so that the sheet can be easily attached to the ceiling in a position underlying the leak. A single light plastic tube extends from the sheet to a selected location such as out of a window for continuously draining water collected in the sheet. By affixing the sheet to the ceiling, there are no stands to obstruct the floor and leaks over a bed, for example, can temporarily be remedied.

BRIEF DESCRIPTION OF THE DRAWINGS

A better understanding of this invention will be had by now referring to the accompanying drawings, in which.

DETAILED DESCRIPTION OF THE PREFERRED EMBODIMENT

Figure 1:
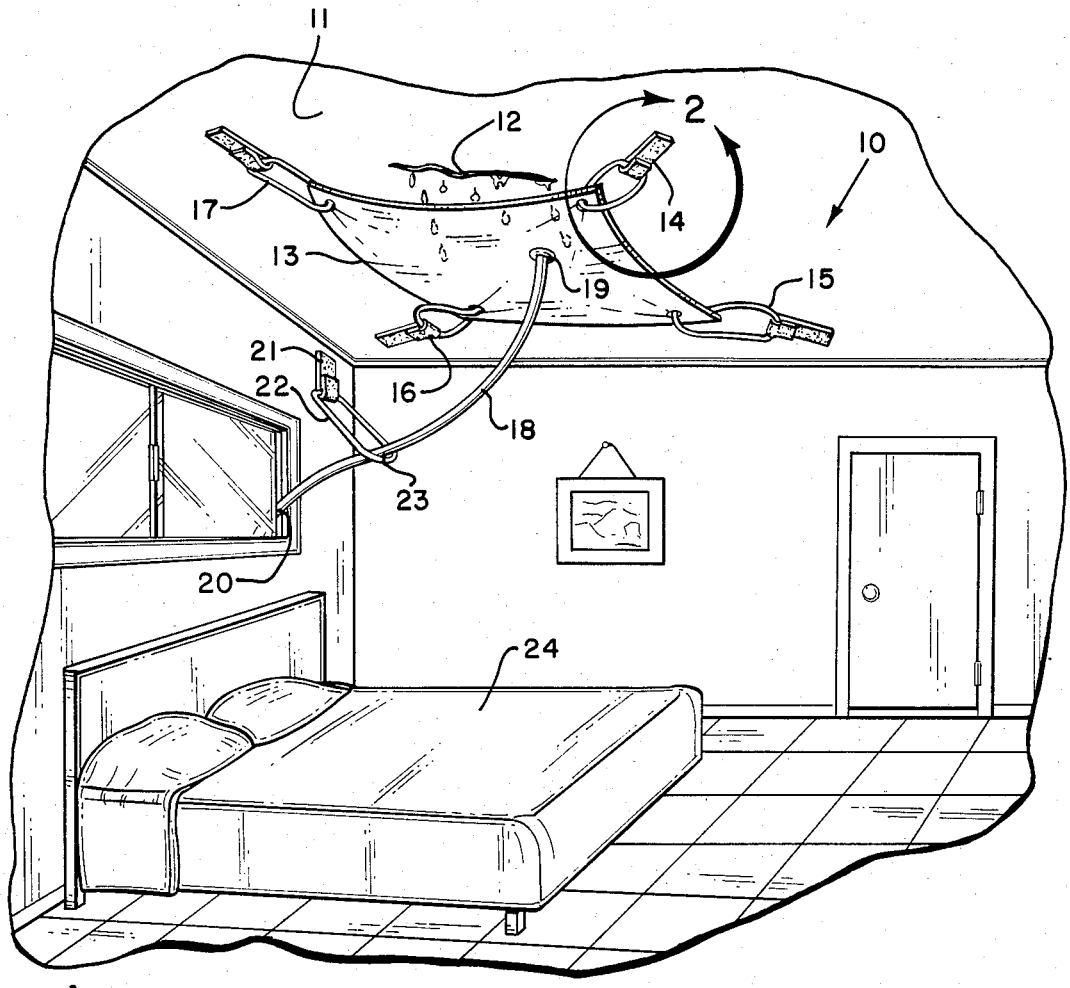
FIG. 1, is a fragmentary perspective view of a typical bed-room in which a leak has developed in the ceiling and wherein the device of the present invention is shown in operation; and, FIG. 2 is an enlarged fragmentary perspective view of that portion of the device enclosed within the circular arrow 2 of FIG. 1.

Referring first to FIG. 1, there is indicated by the arrow 10 a typical bed room having a ceiling 11 in which a leak 12 has developed. As shown, the leak extends along a crack so that multiple dripping is taking place over an extended length.

To remedy the leak in a temporary manner in accord with the present invention there is provided a light water proof plastic sheet member 13. At least three and preferably four as shown fastening means 14, 15, 16 and 17 are provided at the four corners of the sheet at locations defining essentially the vertices of a rectangle. If only three fastening means are used, they would lie on the vertices of a triangle. In either event, the fastening means can be secured to points on the ceiling to position the sheet member beneath the leak as shown.

The device is completed by the provision of a light flexible plastic tube 18 extending from a part of the sheet within the confines of the fastening means locations on the sheet as shown at 19 to a selected location such as out of a window as indicated at 20. In the event the tube 18 is long, an additional fastening means can be provided to support an intermediate point of the tube in an out of the way location from persons in the room. Such a means is shown as an adhesive tape 21 holding a string 22 passing about the intermediate portion of the tube as at 23.

In FIG. 1, the device is shown for remedying a leak over a bed. Clearly, it would be impractical to use any type of stand on the bed as in certain prior art structures in lieu of the ceiling attachments.

Figure 2:
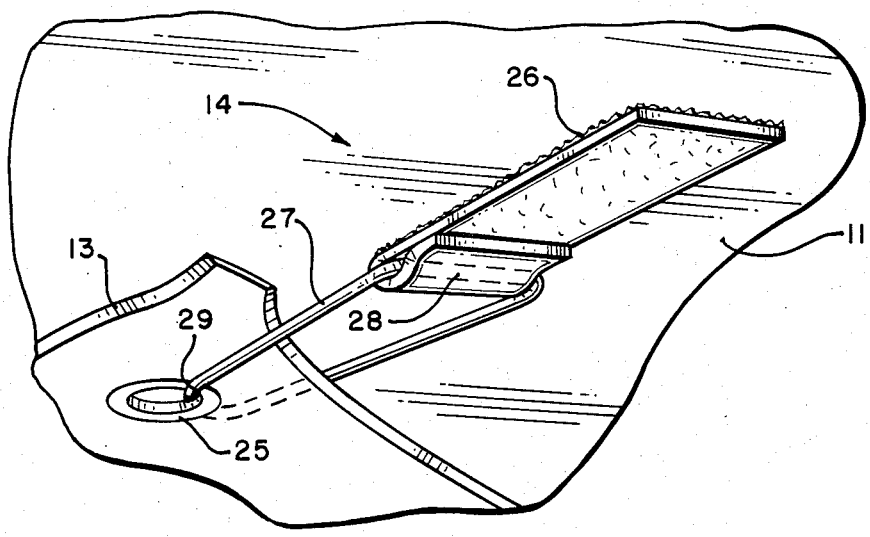

FIG. 2 shows in detail one of the fastening means 14 described in FIG. 1. Since the remaining fastening means 15, 16 and 17 are identical, a detailed description of one will suffice for all.

In FIG. 2 it will be noted that the sheet member 13 includes an eyelet 25 defining a hole at its corner. The fastening means itself includes a water-resistance adhesive tape 26 and a string 27 secured to the tape as at 28. String 27 extends towards the eyelet 25 a given distance and thence passes through the eyelet as at 29 to return to the tape where it is again secured. The given distance of the string for each of the fastening means permits securement at spaced points on the ceiling that are removed from the leak in the ceiling so as to contact a dry area of the ceiling. In addition, the string provides a handy means for permitting pulling of the tape from the ceiling when it is desire to store the device.

From all of the foregoing it will now be evident that the present invention has provided a very handy device for remedying ceiling leaks. Not only can the device be used anywhere without fear of obstructing the floor area, but it is light, unbulky, inexpensive and can be easily stored in a drawer when not in use. Changes falling within the scope and spirit of this invention will occur to those skilled in the area. The invention accordingly is not to be thought of as limited to the one embodiment shown.

I claim:

1. A device for providing a temporary remedy for ceiling leaks including, in combination:

a flexible waterproof plastic sheet member;

at least three individual fastening means connected to said sheet member at three locations defining the vertices of a triangle so that said member can be secured by said fastening means to a ceiling with at least part of the sheet member within said triangle underlying the leak in said ceiling so as to capture water from said leak; and a flexible tube passing from said part of said sheet member to a selected location for continuously passing water collected to said sheet member to said selected location;

said sheet member including at each of said three locations an eyelet defining a hole;

said fastening means each corresponding with a respective one of said eyelets and each including water resistant adhesive tape, and, said fastening means each further including a string for each tape secured to the tape and extending towards the corresponding one of said eyelets a given distance and thence passing through the eyelet and back to the tape where it is again secured to the tape so that said given distance for each of the tapes permits securement at spaced points on the ceiling that are removed from the leak in the ceiling so as to contact a dry area of the ceiling and whereby the tape can easily be pulled from the ceiling by grasping the string when it is desired to store the device.

2. A device for providing a temporary remedy for ceiling leaks including, in combination:

a flexible water-proof plastic sheet member;

at least three individual fasteners connected to said sheet member at three spaced-apart positions defining the vertices of a triangle, said fasteners each including means for releasable attachment to a ceiling with at least part of said sheet member within said triangle underlying a leak in said ceiling whereby said sheet member captures and collects water from said leak; and a flexible tube passing from said part of said sheet member to a selected location remote from said sheet member for continuously draining water collected by said sheet member to said selected location.

* * * * *